US005887394A

United States Patent [19]

Workman

[11] Patent Number: 5,887,394

[45] **Date of Patent: *Mar. 30, 1999**

[54] PROTECTIVE ASSEMBLY FOR REINFORCEMENT BARS

[75] Inventor: Gary Workman, Lombard, Ill.

[73] Assignee: Deslauries, Inc., Bellwood, Ill.

[ * ] Notice: The term of this patent shall not extend beyond the expiration date of Pat. No. 5,613,336.

[21] Appl. No.: 822,224

[22] Filed: Mar. 21, 1997

Related U.S. Application Data

[63] Continuation of Ser. No. 349,250, Dec. 5, 1994, Pat. No. 5,613,336, which is a continuation-in-part of Ser. No. 124, 273, Sep. 20, 1993, Pat. No. 5,447,290.

[51] Int. Cl.[6] ..... E04C 5/16

[52] U.S. Cl. ..... 52/301; 52/741.1

[58] Field of Search ..... 52/300, 301, 741.1, 52/740.1; 256/11; 138/96 R

[56] References Cited

U.S. PATENT DOCUMENTS

| | | | |
|---|---|---|---|
| 5,299,883 | 4/1994 | Arth, Jr. | 52/301 |
| 5,313,757 | 5/1994 | Schnepf | 52/301 |
| 5,363,618 | 11/1994 | Underwood | 52/301 |
| 5,381,636 | 1/1995 | Kassardjian et al. | 52/301 |

*Primary Examiner*—Michael Safavi
*Attorney, Agent, or Firm*—Wood, Phillips, VanSanten, Clark & Mortimer

[57] ABSTRACT

A protective assembly for an exposed end of a reinforcing bar is provided. The protective assembly includes a cover and an insert that is movable relative to the cover. First structure cooperates between the cover and an exposed end of a reinforcing bar for maintaining the cover in an operative position wherein the insert is captive between the cover and an exposed end of a reinforcing bar on which the cover is maintained.

14 Claims, 2 Drawing Sheets

PROTECTIVE ASSEMBLY FOR REINFORCEMENT BARS

CROSS-REFERENCE

This is a continuation of application Ser. No. 08/349,250 filed Dec. 5, 1994, now U.S. Pat. No. 5,613,336, which is a continuation-in-part of now U.S. Pat. No. 5,447,290 application Ser. No. 08/124,273, filed Sep. 20, 1993 now U.S. Pat. No. 5,447,290.

FIELD OF THE INVENTION

This invention relates to protective assemblies for use with reinforcement bars and, more particularly, to covers having an insert associated therewith with the covers being press-fit onto a conventional protective cap which can be fit on an exposed end of a reinforcement bar.

BACKGROUND OF THE INVENTION

Presently, it is known to use caps on exposed ends of individual reinforcement bars used in the construction industry. These caps are designed to prevent the various injuries that can occur through accidental contact with the exposed ends of the reinforcement bars. These caps are generally successful in preventing assorted minor injuries that can arise through contact with the exposed ends of reinforcement bars. More serious injuries which can occur by forceful impacts with the exposed ends of reinforcement bars may not be adequately addressed by the caps, such as when a worker at a construction site falls from an elevated work platform onto the cap covering the exposed end of a reinforcement bar. Workers who fall onto these reinforcement bars having caps thereon are still at a serious risk of being impaled. This risk is aggravated by the fact that oftentimes these workers wear tool belts which can carry heavy tools further adding to the impact force with which a falling worker hits a cap covering the exposed end of a reinforcement bar.

Generally, conventional protective caps are formed from material which is of sufficient impact strength to prevent minor injuries. Typically, the protective caps are formed from cushion-type and/or plastic materials. However, when subject to extreme forces as when a falling worker contacts an exposed end of a reinforcement bar, these materials may be subject to failure. Hence, there is a need to design protective caps that utilize materials having greater impact resistance than the cushion-type and/or plastic materials previously employed. Another factor which contributes to this potential problem is that conventional safety caps do not employ cap heads having impact areas which sufficiently distribute force upon impact therewith. The surface area of the cap heads may not be of sufficient area to distribute the impact force of a falling worker so as to prevent impalement injuries. Thus, it is desirable to increase this impact receiving area to effectively distribute the force of a falling worker when contacted thereon. While it is known to provide protective caps which meet this criteria, it is also desirable to retrofit caps which do not and are currently in use so that they likewise reduce the risk of impalement injuries.

SUMMARY OF THE INVENTION

The present invention is specifically directed to overcoming the above enumerated problems in a novel and simple manner.

In one form of the invention, a protective assembly for an exposed end of a reinforcing bar is provided. The protective assembly includes a cover and an insert that is movable relative to the cover. First structure cooperates between the cover and an exposed end of a reinforcing bar for maintaining the cover in an operative position wherein the insert is captive between the cover and an exposed end of a reinforcing bar on which the cover is maintained.

The first structure includes a protective cap secured to a reinforcing bar to overlie a free end thereof and structure cooperating between the cover and at least one of a reinforcing bar and the protective cap on a reinforcing bar for maintaining the cover in the operative position.

The protective cap has a first surface with a first effective area facing in a first direction with the cap secured to a reinforcing bar and the cover has a wall overlying the first surface with an exposed second surface facing in the first direction with an effective area that is greater than the first effective area with the cover in its operative position.

In one form, the cover defines a receptacle for the insert.

The first cooperating structure preferably includes structure for press fitting the cover into its operative position by relative movement of the cover and a reinforcing bar along a first line.

In one form, the first structure includes the protective cap which has a first shoulder facing in a first direction. A second shoulder on the cover faces oppositely to the first direction. The first structure further includes second structure cooperating between the cover and cap for a) causing at least one of the first and second shoulders to reposition from a first state to a second state as the cap and cover are moved against each other in the first line to allow the first and second shoulder to move past each other and b) allowing at least one of the first and second shoulders to move back to the first state wherein the first and second shoulders confront each other to prevent separation of the cover and protective cap by movement away from each other in the first line with the cover in its operative position.

The second structure preferably includes a ramp surface on at least one of the cover and protective cap.

In one form, the protective cap has a skirt depending from the cover wall with the skirt surrounding the insert with the cover in its operative position.

The insert preferably is formed from an impact resistance material.

In one form, the impact resistance material includes at least one of plastic and metal.

In one form, the insert has a third surface overlying the first surface and facing in the first direction with the cover in its operative position.

The third surface preferably has an area which is at least as great as the first effective area.

In one form, one of the protective cap and the cover has a wall part and the corresponding at least one ramp surface is on the wall part of one of the cap and cover such that upon movement of the cap against the cover the wall part deforms in a direction transverse to the first line.

In one form, the cover has a wall extending transversely to the first line and a skirt depending from the wall, with the skirt surrounding the insert with the cover in its operative position and the at least one ramp surface is on the skirt at an end thereof distal from the wall.

In one form, the protective assembly is in combination with a reinforcing bar having an exposed end.

The first structure preferably includes structure for removably maintaining the insert in the receptacle.

In one form, the cover wall includes structure for allowing visual inspection of the position of the insert with the cover in its operative position.

The inspection structure preferably includes a hole extending through the cover wall and overlying the protective cap with the cover in its operative position.

The invention further contemplates a method of captively maintaining an insert between a cover and a protective cap overlying an exposed end of a reinforcement bar. The method includes the steps of placing a protective cap on a reinforcement bar to overlie a free end thereof, providing a cover defining a receptacle, placing an insert in the receptacle, inserting the protective cap in the receptacle, and connecting the cover to at least one of the reinforcing bar and protective cap to maintain the cover in an operative position wherein the insert is captive in the cover receptacle between the cover and the protective cap.

The method may include the step of providing generally oppositely facing ramp surfaces on the cover and cap to guide relative movement between the cover and cap along a first line. The step of inserting the protective cap in the receptacle preferably includes moving the cover ramp surface against the cap ramp surface in the first line.

In one form, the step of moving the cover ramp surface against the cap ramp surface includes the step of deforming a wall part on which one of the cover ramp surface and the cap ramp surface is formed in a direction transverse to the first line.

In one form, the step of connecting the cover to at least one of the reinforcing bar and protective cap to maintain the cover in the operative position includes the step of moving the cover ramp surface past the cap ramp surface so that a shoulder on the cover and a shoulder on the cap confront one another to prevent separation of the cover and the protective cap by movement away from each other in the first line with the cover in its operative position.

The step of moving the cover ramp surface past the cap ramp surface preferably includes the steps of repositioning at least one of the ramp surfaces from a first state to a second state as the cap and cover are moved against each other in the first line and allowing the at least one of the ramp surfaces to move back to the first state when the cap moves past the cover.

DETAILED DESCRIPTION OF THE INVENTION

Figure 1:
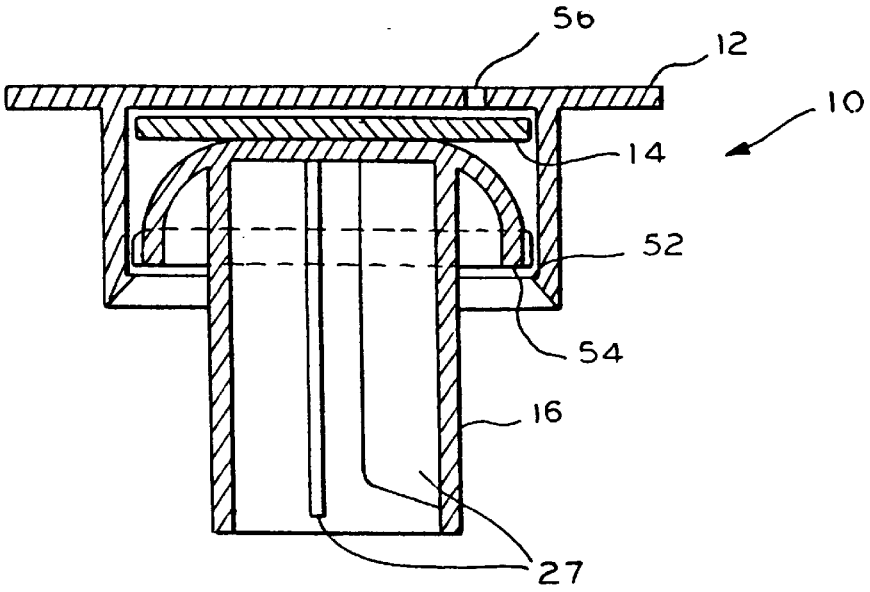
FIG. 1 is a cross-sectional view of the protective assembly including a cover, an insert and a protective cap, according to the present invention.
Figure 3:
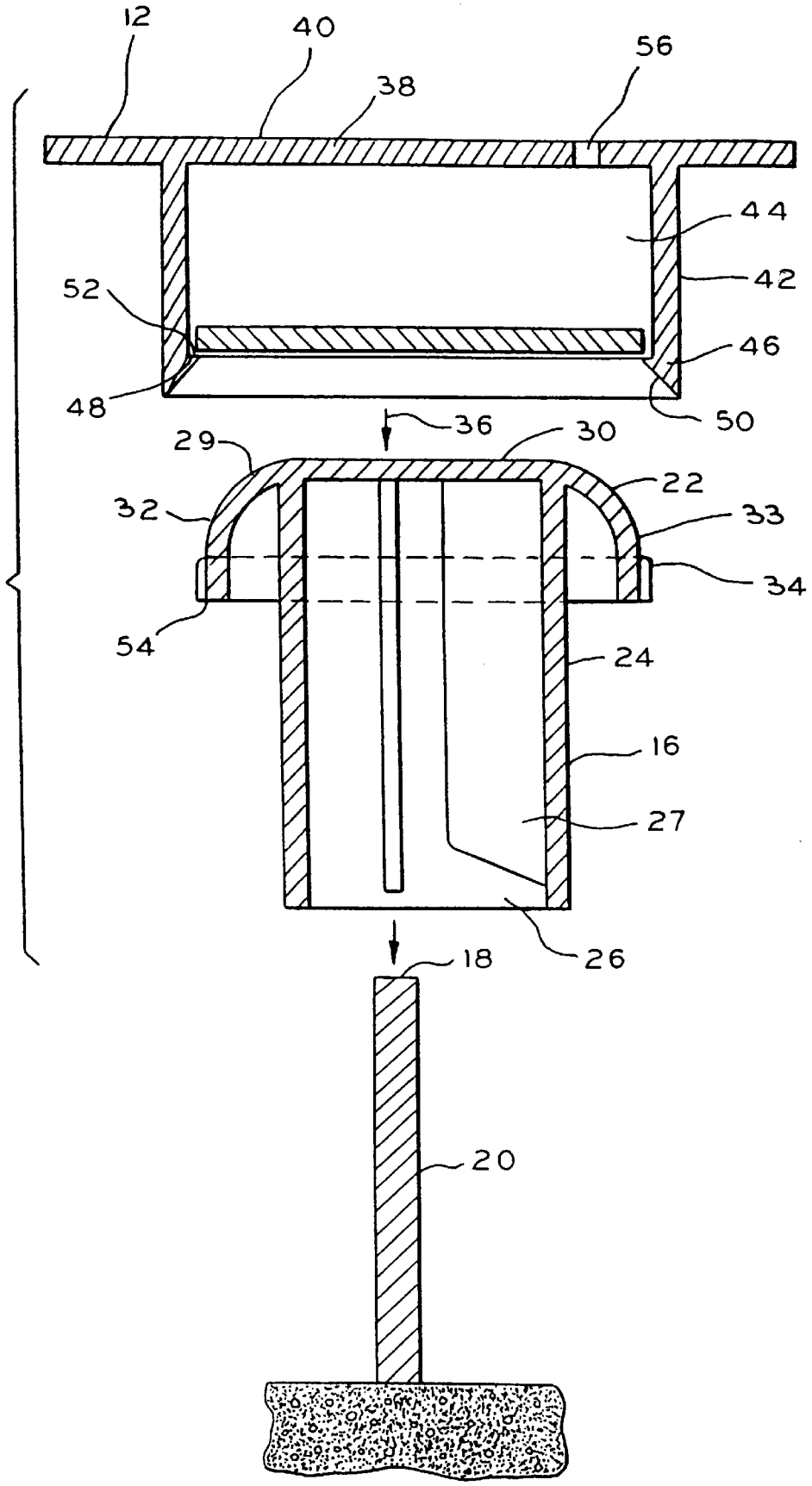
FIG. 3 is an exploded cross-sectional view of the protective assembly and a reinforcing bar.

In FIG. 1, a protective assembly, according to the present invention, is shown at 10. The protective assembly 10 comprises a cover 12 and an insert 14 associated with the cover 12. The protective assembly 10 further contemplates utilizing a conventional protective cap 16 which can be securely fit over an exposed end 18 of a reinforcing bar 20, as is known in the art (FIG. 3).

More particularly, the protective cap 16 has a head 22 and a cylindrical body 24 with the head 22 closing one end of the cylindrical body 24. The cylindrical body 24 defines an interior space 26 accessible through the open end of the cylindrical body 24. The protective cap 16 can thereby receive the exposed end 18 of the reinforcement bar 20 in its interior space 26.

The illustrated protective cap 26 has a fin assembly 27 connected to the cap body 24 extending into the interior space 26. When the reinforcement bar end 18 is inserted into the interior space 26, the fin assembly acts to frictionally engage and surround the end 18 of the reinforcement bar 20 extending into the interior space 26 such that the cap 16 is securely maintained over the reinforcement bar end 18.

The illustrated protective cap 16 is formed from either a cushion-type or plastic material. The cap head 22 has a top surface 29. The cap head 22 includes a flat portion 30 transverse to the cap body 24 and a curved portion 32 depending from the flat portion 30. The top surface 29 includes a rounded ramp surface 33 on the curved portion 32. At the bottom end of the curved portion 32 a circumferential ridge 34 can be provided, with the ridge 34 extending around the bottom of the curved portion 32.

Conventional protective caps 16 can be effective in preventing minor injuries but generally may not be effective in extreme circumstances, as in preventing impalement injuries caused by workers falling onto the protective caps 16 fitted on the ends 18 of reinforcement bars 20. This is in part due to the fact that the protective caps are not formed from high impact resistant material and/or because the protective cap 16 does not have a surface area on the flat portion 30 thereof which is sufficient to distribute the great force of a falling worker thereon so as to prevent impalement. As such, it is desirable to provide a structure and method for retrofitting conventional protective caps 16 currently in use so that they are more likely to prevent impalement injuries. The protective assembly 10 described herein addresses this need.

The insert 14 is normally movable with respect to the cover 12. According to the invention, the cover 12 and insert 14 can be directed onto protective caps 16 along a line, as indicated by arrow 36, such that the insert 14 is maintained in a captive position between the cover 12 and the protective cap 16. The insert 14 is formed from an impact resistant material such as steel to further increase the impact resistance of the protective assembly 10. Thus, when the cover 12 is in its operative position as seen in FIG. 1, the insert 14 is captive between the cover 12 and cap 16 and thereby overlies the protective cap 16, reducing the risk of impalement injuries occurring on the protective assembly 10.

Figure 2:
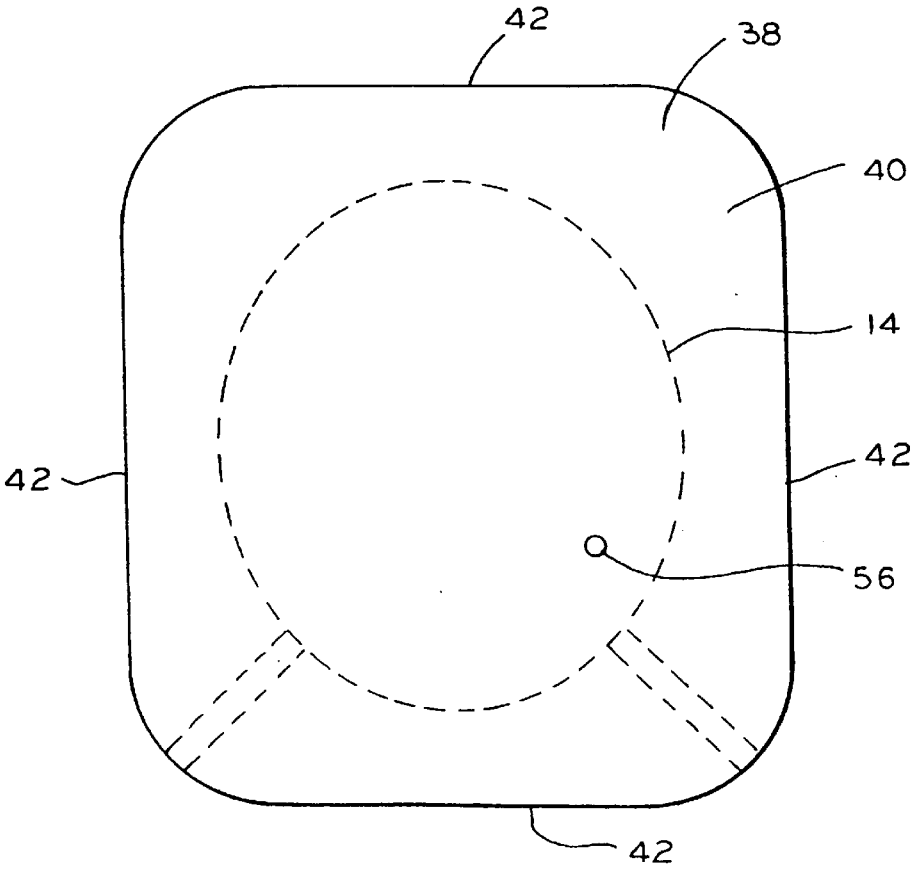
FIG. 2 is a plan view of the cover with an inspection hole provided therein.

The cover 12 has a wall 38 which overlies the protective cap 16 and extends transversely to the reinforcement bar 20 when the cap 16 is placed thereon in its operative position. The cover wall 38 has a top surface 40 for distributing impact force facing in a first direction away from the reinforcement bar 20. As can be seen in FIG. 2, the top surface 40 has a greater surface area than the surface area of the top surface 29 of the head 22 of the protective cap 16 which faces in the same direction as the top surface 40, i.e., in the first direction away from the reinforcement bar 20, with the cover 12 in its operative position. In other words, when viewed from a position above the cap 16 in line with the reinforcement bar 20, an effective surface area having a generally circular outline circumscribing the top surface 29 of the cap head 22 can be seen (see FIG. 2) with the effective surface area being less than the surface area of the overlying wall surface 40. The top surface 40 is formed in a substantial square shape with the corners thereof rounded off such that sharp corners do not protrude from the wall 38, as also seen in FIG. 2. To meet safety requirements, the top surface 40 has a surface area of at least 16 square inches and the distance across the top surface 40 between opposite sides 42 thereof is approximately four inches. Such a surface area is believed to help prevent impalement through distribution of impact force.

The protective cap 16 has a skirt 42 depending from the cover wall 38. The skirt 42 can have a cylindrical configuration and define a receptacle 44 for the insert 14.

The skirt 42 has an end 46 thereof distal from the cover wall 38. An inwardly directed circumferential projection 48 is provided at the skirt end 46 and extends therearound. The projection 48 has a ramp surface 50 such that when the cover 12 is moved to its operative position along the line in the direction of arrow 36 onto the protective cap 16, the ramp surface 50 of the cover 12 and the rounded ramp surface 33 of the cap head 22 engage one another to allow at least one of the cover 12 and cap 16 to deform in a direction transverse to the line 36 of movement between the cover 12 and cap 16.

The projection 48 is further provided with a shoulder 52 which allows the insert 14 to be removably maintained in the cover receptacle 44. When the insert 14 is inserted into the receptacle 44, the insert 14 rests on the shoulder 52 at the edges of the insert 14. As the cover 12 is placed on the protective cap 16 as by movement of the ramp surfaces 33 and 50 against one another, the insert 14 will engage the flat portion 30 of the cap head 22. As the ramp surfaces 33 and 50 engage one another, they cooperate to allow the projection 48 to move past the cap head 22. After the projection 48 has moved past the head 22, a shoulder 54 defined by the circumferential ridge 34 is oriented such that it is in confronting relation with the projection shoulder 52 to securely maintain the cap head 22 in the receptacle 44 of the cover 12. Hence, the above-described press-fitting of the cover 12 onto the cap 16 includes movement of the ramp surfaces 33 and 50 and shoulders 52 and 54 past one another such that the cover 12 and cap 16 assume their operative position with the insert 14 captively maintained therebetween, see FIG. 1.

To ensure that the insert 14 is appropriately positioned between the cover 12 and the cap head 22, an inspection hole 56 is provided in the cover wall 38, as best seen in FIG. 2. The inspection hole is spaced radially inwardly from the skirt 42 such that it extends through the cover wall 38.

By providing the cover 12 and insert 14, a conventional protective cap 16 can be retrofit such that the requisite safety criteria necessary to prevent impalement thereon are met. The cover 12 through the top surface 40 has sufficient area to assist in distributing the impact force generated by a falling worker. The insert 14 further ensures against impalement by providing the necessary impact resistance in preventing impalement. Thus, the foregoing protective assembly 10 is effective in reducing the incidences of impalements on reinforcement bars without necessitating the replacement of conventional protective caps 16 with entirely new protective caps designed to meet impalement safety criteria.

The foregoing disclosure and specific embodiment is intended to be illustrative of the broad concepts comprehended by the invention.

I claim:

1. A protective assembly mountable to an exposed end of a reinforcing bar, said protective assembly comprising:

a metal plate;

a support body removably mountable to an exposed end of a reinforcing bar; and means removably attached to the support body and operatively associated with the metal plate for securing the metal plate to the support body in an operative position to prevent penetration of the protective assembly by an end of a reinforcing rod, the means including a receptacle in which the support body is received.

2. The protective assembly according to claim 1, wherein the support body has a wall defining a receptacle and fins extending from the wall into the receptacle.

3. The protective assembly according to claim 2, wherein the support body is plastic.

4. A protective assembly mountable to an exposed end of a reinforcing bar, said protective assembly comprising:

a cover;

an insert;

a support body removeably mountable to an exposed end of a reinforcing bar; and means for removably securing the cover to the support body with the insert captive between the cover and the support body in an operative position to prevent penetration of the protective assembly by an end of a reinforcing rod.

5. The protective assembly according to claim 4, wherein the insert is formed from an impact resistant material.

6. The protective assembly according to claim 4, wherein the support body has a wall defining a receptacle and fins extending from the wall into the receptacle.

7. The protective assembly according to claim 6, wherein the cover and the support body are plastic, and the insert is metal.

8. The protective assembly according to claim 4, wherein the support body has an end with a first effective surface area facing in a first direction; and the cover has a surface which overlies the end of the support body, the surface having a second effective surface area facing in the first direction which is greater than the first effective surface area.

9. The protective assembly according to claim 8, wherein the second effective surface area in the first direction is at least 16 square inches.

10. The protective assembly according to claim 4, wherein the support body is a protective cap.

11. The protective assembly according to claim 4, wherein:

the support body has a shoulder facing in a first direction, the cover has a shoulder facing oppositely to the first direction, and the means for securing the cover to the support body includes means for causing at least one of the support body shoulder and the cover shoulder to reposition from a first state to a second state as the support body and the cover are moved against each other in a first line to allow the support body shoulder and the cover shoulder to move past each other and for allowing the at least one of the support body shoulder and the cover shoulder to move back to the first state wherein the support body shoulder and the cover shoulder confront each other to prevent separation of the cover and the support body by movement away from each other along the first line.

12. The protective assembly according to claim 11, wherein the means for causing at least one of the support body shoulder and the cover shoulder to reposition and for allowing the at least one of the support body shoulder and the cover shoulder to move back comprises a ramp surface on at least one of the cover and the support body.

13. The protective assembly according to claim 12, wherein the at least one of the cover and the support body has a wall and the ramp surface is on the wall such that upon movement of the support body against the cover the wall deforms in a direction transverse to the first line.

14. The protective assembly according to claim 4, in combination with a reinforcing bar having an exposed end, the support body mounted on the exposed end of the reinforcing bar.

* * * * *